US006547289B1

(12) United States Patent
Greenheck et al.

(10) Patent No.: US 6,547,289 B1
(45) Date of Patent: Apr. 15, 2003

(54) QUICK RELEASE LATCH MECHANISM

(75) Inventors: James D. Greenheck, Schofield, WI (US); Eugene J. Heil, Marathon, WI (US)

(73) Assignee: C-Tech Trailer Cabinets, Schofield, WI (US)

( * ) Notice: Subject to any disclaimer, the term of this patent is extended or adjusted under 35 U.S.C. 154(b) by 79 days.

(21) Appl. No.: 09/708,803

(22) Filed: Nov. 8, 2000

Related U.S. Application Data

(60) Provisional application No. 60/166,075, filed on Nov. 17, 1999.

(51) Int. Cl.[7] ..... E05C 19/10

(52) U.S. Cl. ..... 292/126; 292/100; 292/200; 312/333

(58) Field of Search ..... 312/222, 215, 312/333; 292/124, 126, 226, 100, 200

(56) References Cited

U.S. PATENT DOCUMENTS 1,241,192 A * 9/1917 Bruder ..... 292/124
3,117,731 A * 1/1964 Rackley et al. ..... 240/147
3,239,298 A * 3/1966 McCarthy ..... 312/234.3
3,252,746 A * 5/1966 Kafferlin et al. ..... 312/234.3
4,006,951 A * 2/1977 Geer et al. ..... 312/320
4,018,148 A * 4/1977 Wolbrink ..... 100/53
4,023,875 A * 5/1977 Difley et al. ..... 312/319
4,068,872 A * 1/1978 Smith ..... 292/87
4,239,309 A * 12/1980 De Fouw et al. ..... 312/221
4,947,661 A * 8/1990 Yoshida ..... 70/57
5,292,191 A * 3/1994 Slivon ..... 292/128
5,445,451 A * 8/1995 Harmony ..... 312/333
5,868,478 A * 2/1999 Yemini ..... 312/332.1

* cited by examiner

*Primary Examiner*—Anthony Knight
*Assistant Examiner*—John B. Walsh
(74) *Attorney, Agent, or Firm*—Quarles & Brady LLP

(57) ABSTRACT

Disclosed herein is an improved drawer latch mechanism, particularly suited for attaching to the front side of a drawer. The drawer front latch preferably has a handle with a full-length grip that is sufficiently large so that it may be operated while wearing gloves, holding a towel or other types of hand coverings. The handle is used to open and close the drawer such that the action of pulling on the handle to open the drawer releases spring-loaded latches biased to be in a locked position. Pushing the drawer closed causes catch surfaces of tapered leading ends of the latch to engage with drawer mounting walls of the cabinet and latch the drawer closed.

22 Claims, 6 Drawing Sheets

QUICK RELEASE LATCH MECHANISM

CROSS-REFERENCE TO RELATED APPLICATIONS

This application claims the benefit of U.S. provisional application Ser. No. 60/166,075, filed Nov. 17, 1999.

STATEMENT REGARDING FEDERALLY SPONSORED RESEARCH OR DEVELOPMENT (Not applicable.)

BACKGROUND OF THE INVENTION

Drawers, such as those used in tool chests, are well-known to have latching mechanisms to protect against theft or unexpected opening in the event the chest is moved or tipped upright. Common latch mechanisms include key or combination locks and sliding levers restraining movement of the drawers. Such latch mechanisms typically require the user to apply both hands to the latch in order to open the drawer. Moreover, typical latch mechanisms often include small components that are difficult to operate while wearing hand coverings.

BRIEF SUMMARY OF THE INVENTION

The present invention provides an improved drawer latch mechanism, particularly suited for attaching to the front side of a cabinet drawer. The latch mechanism of the present invention allows a drawer to be unlatched with one hand in the single motion needed to open the drawer.

Specifically, a support is mounted at the front face of the drawer which provides a pivotal connection to which a handle is attached so that it can pivot with respect to the front of the drawer. A latch is also attached at the pivotal connection. The latch is operated by the handle to pivot between a closed position in which the latch engages the cabinet (or drawer mount) and an open position in which the latch is free from the cabinet. In this way, the latch can be pivoted to open when the drawer is pulled by the handle.

In one preferred form, the latching mechanism includes a spring biasing the latch closed. Additionally, the latch preferably has a leading end that includes a downwardly extending catch surface that engages a cabinet wall when the latch is in the closed position. The leading end is tapered to define an angled surface that travels up and into a latch opening so that the catch surface engages the cabinet wall.

In another preferred form, the support member is wider than the drawer front and the latching mechanism has two latches, one at each end of the support member with the drawer front disposed therebetween. The support member also has a downwardly extending lip which engages a top edge of the drawer front to mount the latch mechanism to the drawer.

The support member and the handle can be extruded components with the pivotal connection extending the length of the support member. The handle has a grip, preferably extending its length, sized so that it may be grasped while wearing gloves, mittens, etc.

The foregoing and other advantages of the invention will appear from the following description. In this description reference is made to the accompanying drawings which form a part hereof and in which there is shown by way of illustration a preferred embodiment of the invention. Such embodiment does not necessarily represent the full scope of the invention.

DETAILED DESCRIPTION OF THE PREFERRED EMBODIMENTS

Figure 1:
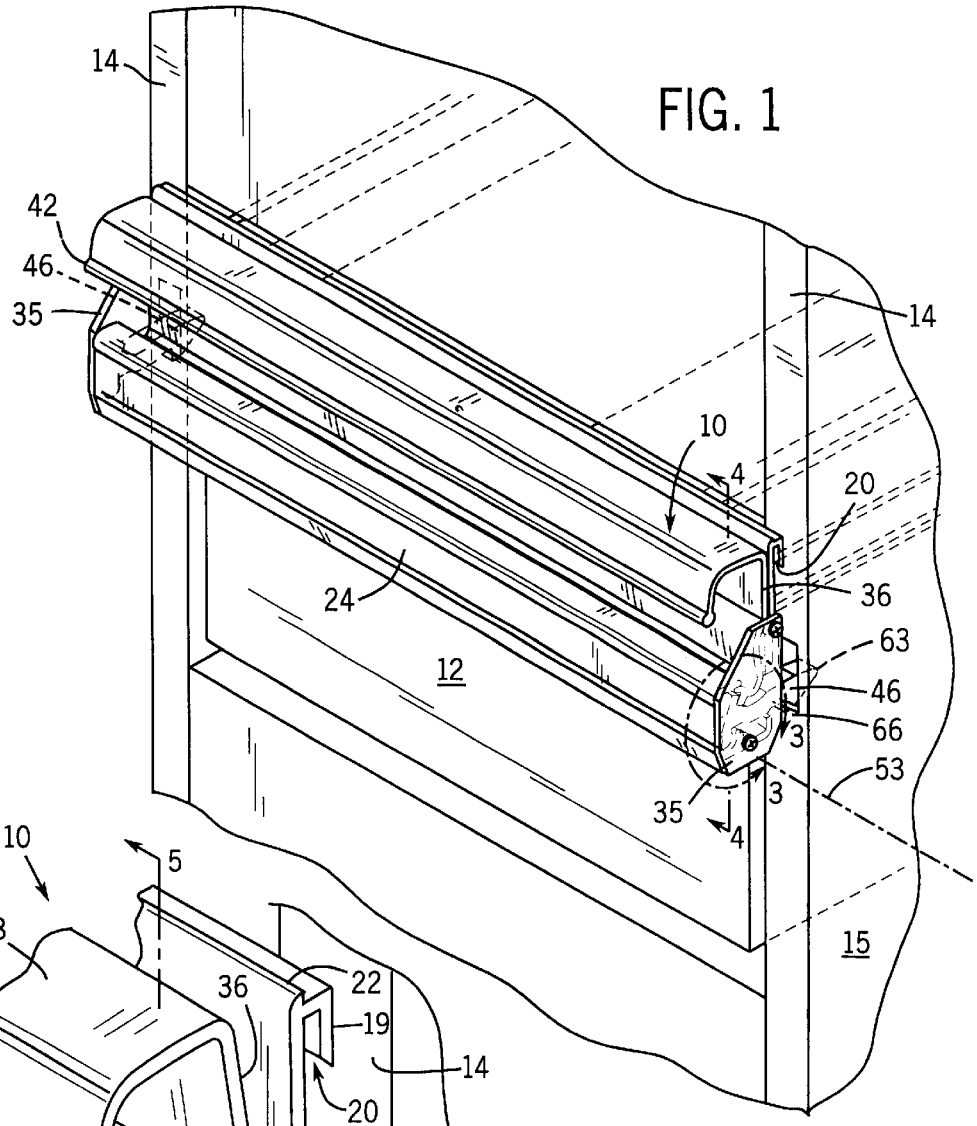
FIG. 1 is a front perspective view of the drawer front latching mechanism of the present invention, shown connected to a front of a drawer.
Figure 3:
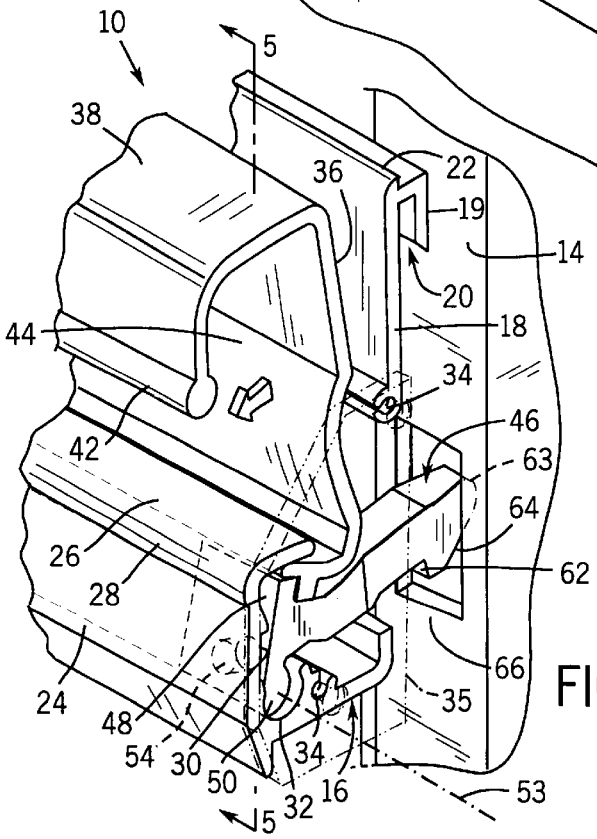
FIG. 3 is an enlarged perspective view of one end of the latching mechanism with an end cap shown in phantom.
Figure 2:
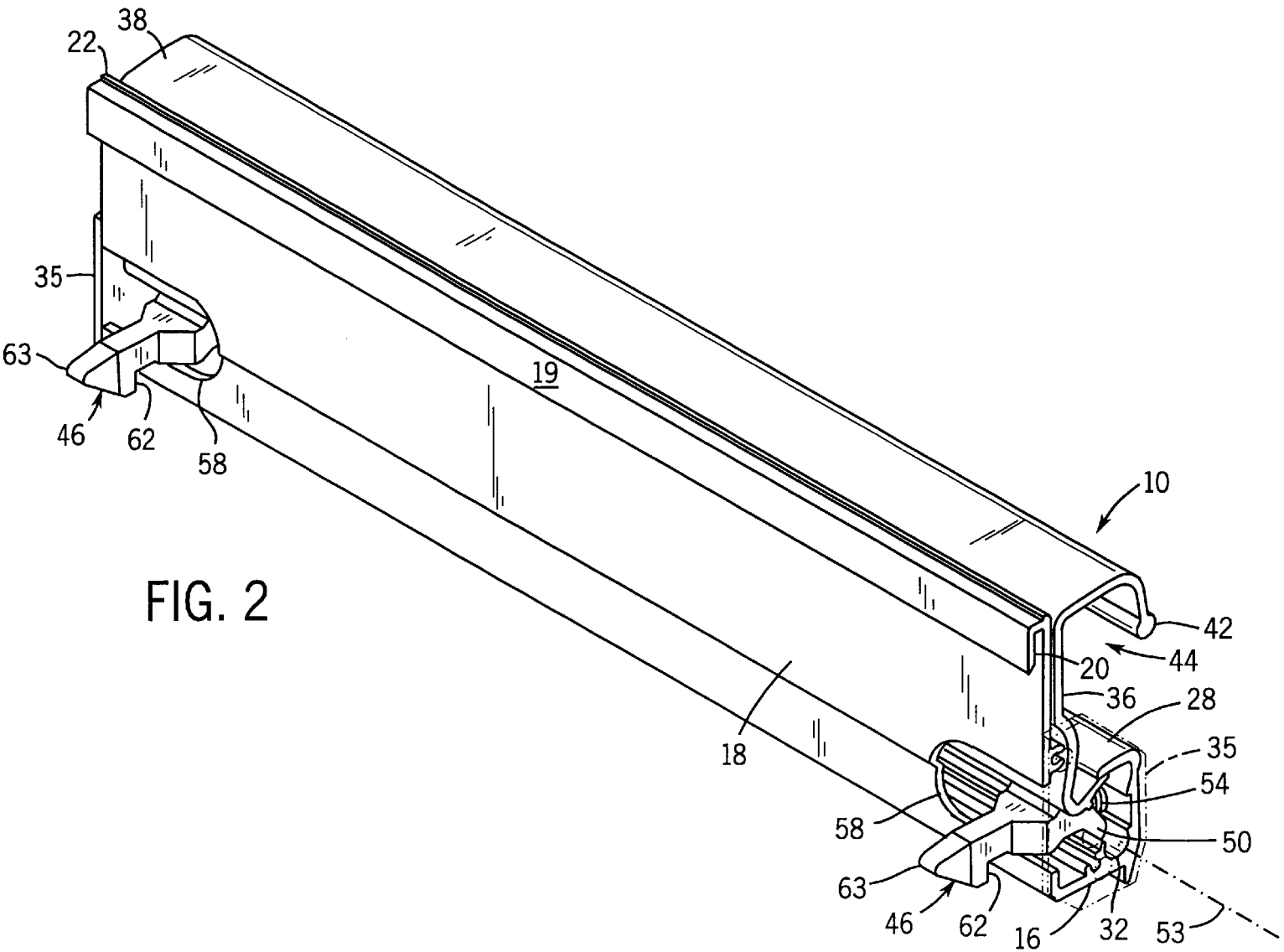
FIG. 2 is a back perspective view of the drawer front latching mechanism of FIG. 1, shown detached from the drawer.

Referring to FIG. 1, the drawer front latching mechanism 10 can be attached at a front surface of a drawer 12 slidable within a drawer mounting frame 14 of a cabinet 15. Referring to FIGS. 1–3, the latching mechanism 10 includes a support member 16 that has a generally hook-shaped cross-section. The support member 16 is preferably extruded aluminum or plastic extending a length greater than that of the front surface of the drawer 12 to which it is being attached. The support member 16 includes a back plate portion 18 preferably having an angled upper lip 19 forming an inverted channel 20 extending along a rear top edge 22 for attaching the drawer front latching mechanism 10 to the drawer 12. It should be noted that the latching mechanism 10 of the present invention could be attached to the drawer with suitable adhesives or fasteners, such as threaded fasteners, instead of, or in addition to, the inverted channel 20. The support member 16 has a lower extremity defining a front wall or face portion 24 having an inwardly extending lip 26 at its top edge 28. The face portion 24 includes a lengthwise channel 30 along a middle portion and an arcuate pivot groove 32 along a bottom of the inside surface of the face portion 24. The support member 16 also includes two threaded grooves 34, suitably located along the support member 16, for receiving threaded fasteners for securing an end cap 35 at each end of the support member 16.

Referring to FIGS. 1 and 3, an elongated handle 36, also preferably extruded aluminum or plastic, has an arcuate bottom edge (not shown) sized to fit within the pivot groove 32 of the support member 16. The pivotal handle 36 also includes a generally L-shaped grip 38 extending from a top end 40 of the handle 36 outwardly from the drawer 12 and downward. The grip 38 terminates in a lengthwise bead 42 and forms a hand grip for grasping the handle 36 when opening the drawer. The grip 38 and the lip 26 of the support member face portion 24 define a cavity 44 sized large enough to grasp the lip 38 while wearing hand coverings, such as gloves and mittens. The lip 26 of the support member face portion 24 acts to retain the handle 36 within the support member 16 and restrict its rotation. The handle 36 has notched bottom comers sized to accommodate spring biased latches 46.

Figure 4:
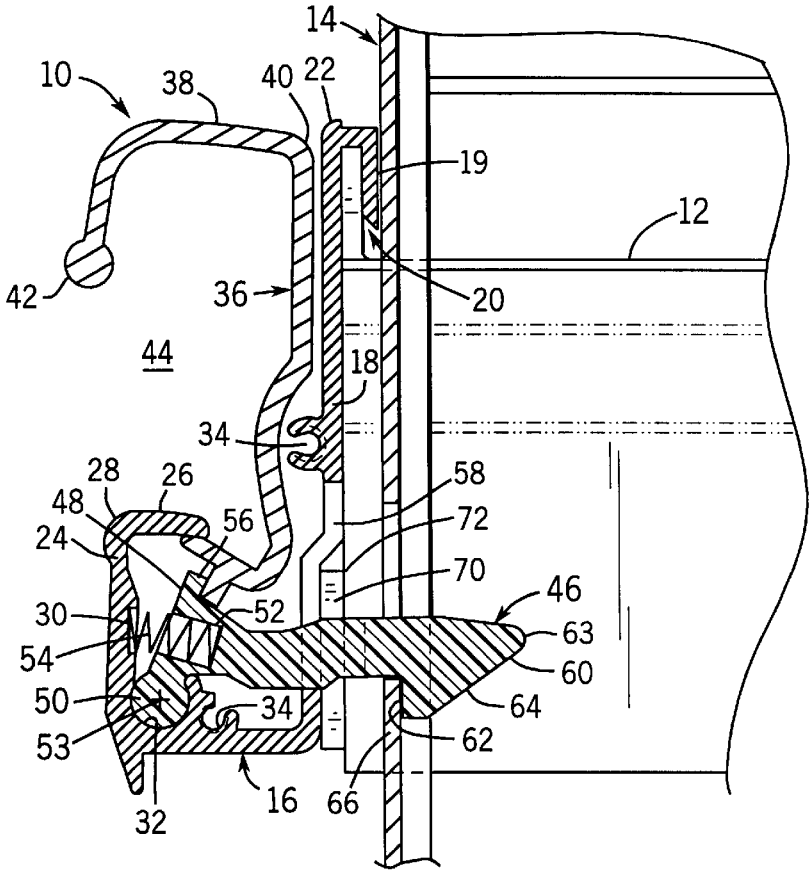
FIG. 4 is a cross-section view taken along line 4—4 of FIG. 1, showing the drawer closed and the latches locked.

Referring to FIGS. 2, 3 and 4, each latch 46, preferably made of metal or a suitable rigid plastic, has a trailing end 48 defining an arcuate projection 50 sized to fit within the pivot groove 32 of the support member 16. Referring specifically to FIG. 4, the trailing end 48 of each latch 46 has a bore 52 sized to receive a compression spring 54 extending from the middle channel 30 of the support member face portion 24. The trailing end 48 of the latches 46 also includes a ledge 56 that is engaged by the handle 36 as it is pivoted. The latches 46 extend inwardly from this end 48 through openings 58 in the back plate portion 18 of the support member 16 to a tapered leading end 60. Each tapered leading end 48 defines a lateral catch surface 62 and an angled bottom surface 64 extending downward from a leading edge 63 to the catch surface 62.

Figure 5:
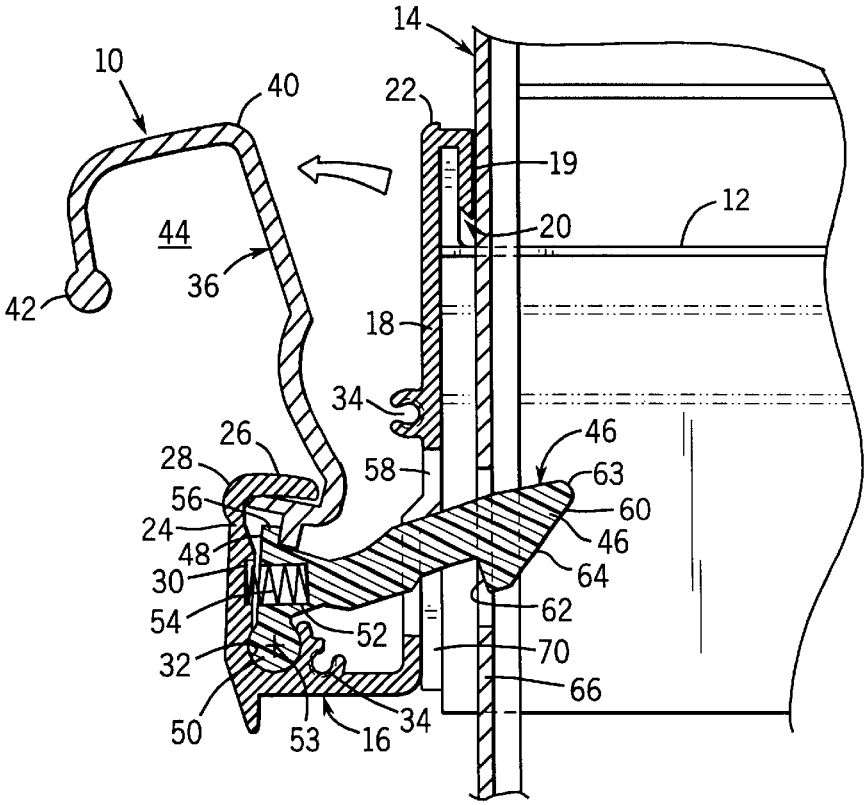
FIG. 5 is a side cross-section view taken along line 5—5 of FIG. 3, showing the drawer closed and the latches unlocked.
Figure 6:
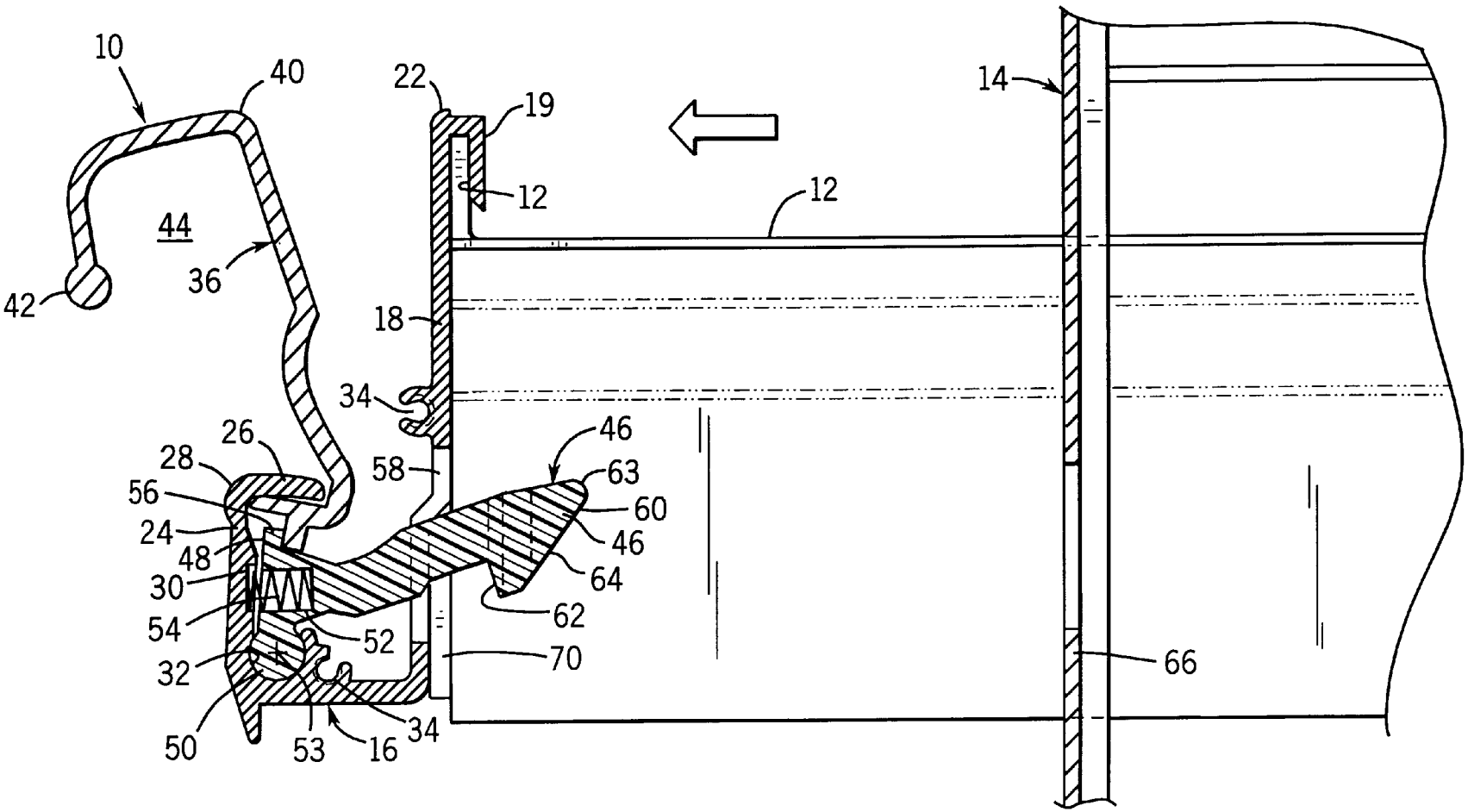
FIG. 6 is a side cross-section view similar to FIG. 5, showing the drawer opened.

Referring to FIGS. 1 and 4, the latch mechanism 10 is affixed to the drawer 12 by placing the inverted channel 20 over the top edge of the drawer front with the lip 19 within the drawer 12. A suitable adhesive or threaded fastener may be used to secure the latch mechanism 10 in place. With the handle 36 released and the drawer 12 shut as shown in FIG. 4, a user can grasp the grip 38 of the handle 36 by inserting his or her fingers into the cavity 44 defined by the handle 36 and support member 16. By pulling outwardly, the handle 36 pivots within the pivot groove 32 in a counterclockwise direction with respect to the support member 16 about a pivot axis 53. As the handle 36 is rotated, the ledges 56 of the latches 46 are engaged by the handle 36, which pivots the latches 46 within the pivot groove 32 about the pivot axis 53 toward an open position, as shown in FIG. 5. This action disengages the leading end catch surface 62 of each latch 46 from a corresponding fixed stop portion 66 of the drawer mounting frame suitably located at the sides of the drawer 12. The drawer 12 can then be opened by continuing to pull outward, as shown in FIG. 6. Thus, using the latching mechanism 10 of the present invention, the drawer 12 can be easily unlatched and opened with one hand by pulling outward on the handle in a single motion.

Furthermore, due to the forces exerted by the compression spring 54, the handle 36 and latches 46 return to a locked position automatically when the handle is released. Consequently, as the drawer 12 is closed, by pushing inwardly on any part of the latching mechanism 10, the angled surfaces 64 of the leading ends 60 of the latches 46 travel up and over the stop portions 66 so that the catch surfaces 62 engage the stop portions 66 and lock the drawer 12 shut, as in FIG. 4. The movement of the latches 46 to lock the drawer 12 occurs independent from, and without movement of, the handle 10.

The drawer front latching mechanism 10 can be used with drawers of any length and depth. The length of the latching mechanism 10 can be varied as needed according to the length of the drawer front. The height of the latching mechanism 10 can also be varied, however, preferably the height remains constant and a suitable facing 70 is disposed at the front of the drawer 12. Referring to FIGS. 4–6, the latching mechanism 10 is attached proximate the top of the drawer front and a top portion of the facing 70 fits within a gap 72 defined by the drawer front and an offset in the back plate 18. The facing 70 may be affixed to the back plate 18 and/or the front of the drawer 12 using suitable adhesives or fasteners and is sized as needed to cover the front of the drawer not covered by the latch mechanism 10.

Figure 7:
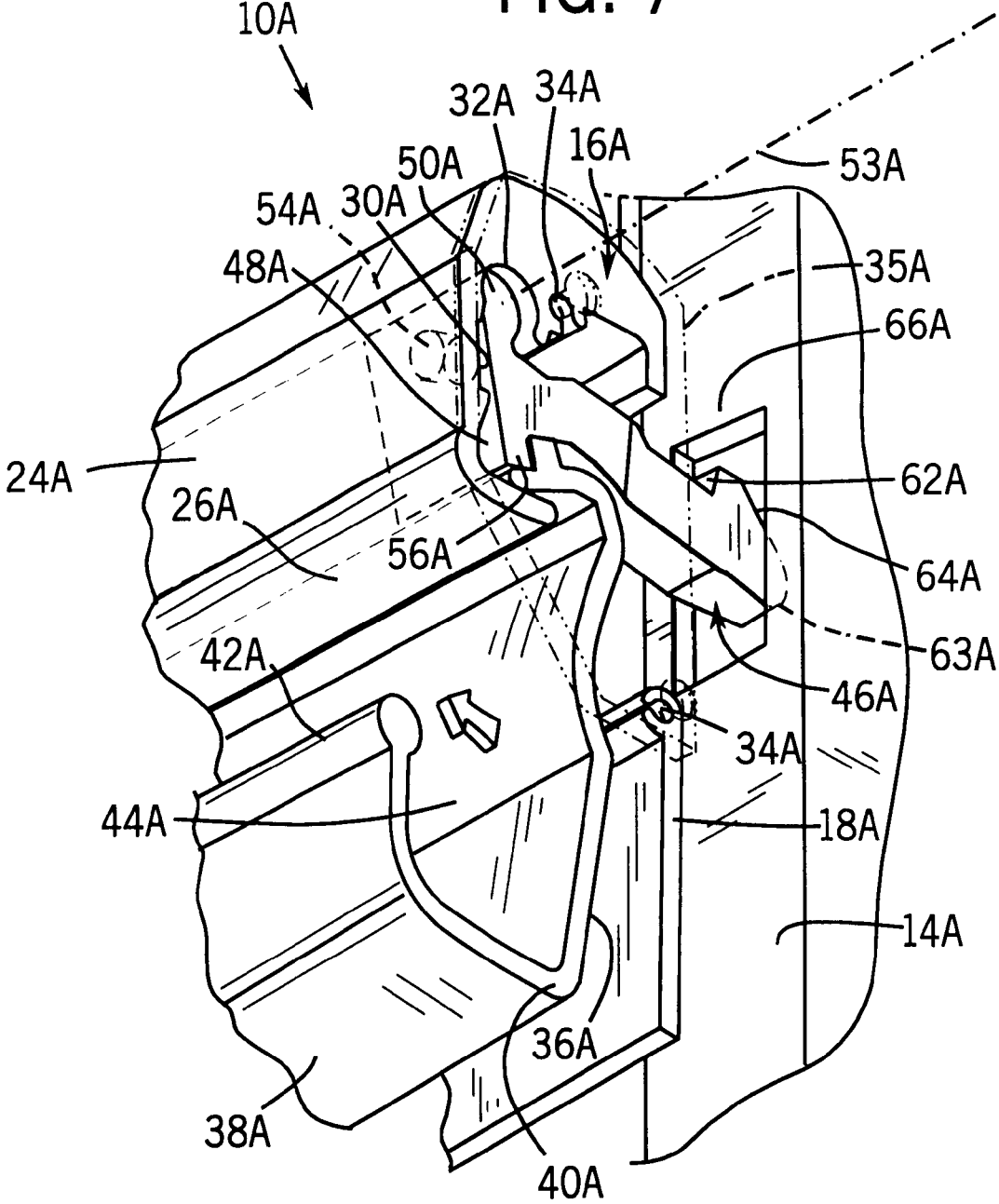
FIG. 7 is a partial perspective view showing one end of an alternate, inverted embodiment of the latching mechanism.
Figure 8:
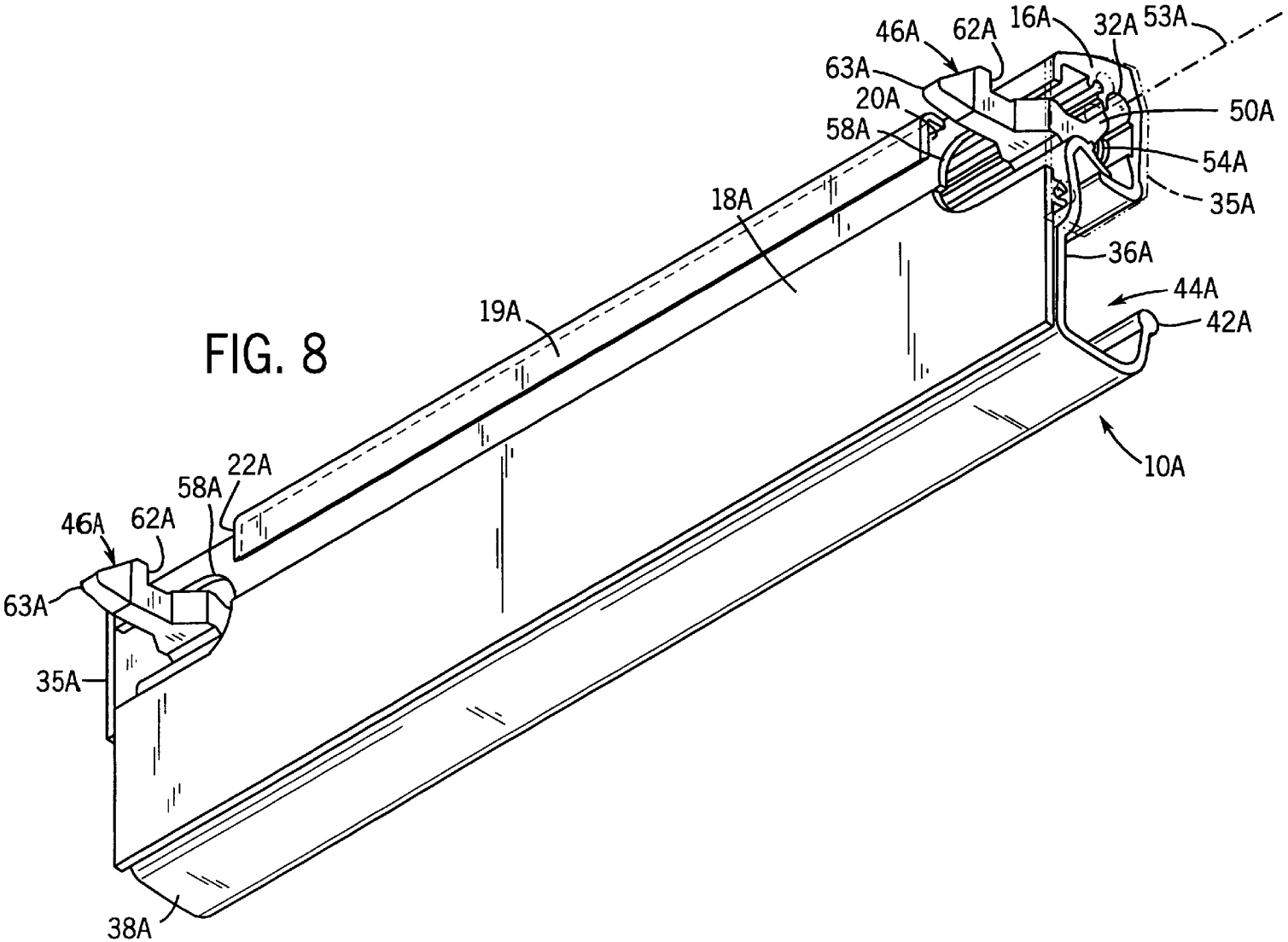
FIG. 8 is a back perspective view of the drawer front latching mechanism of FIG. 7, shown detached from the drawer.

An alternate, inverted embodiment of the latch mechanism is shown in FIGS. 7 and 8 in which the handle extends downwardly toward the bottom of the drawer. Similar reference numerals are used to reference elements similar to those in the above described embodiment albeit with the suffix A. The latch mechanism 10A of this embodiment is constructed similar to the first embodiment, however, an inverted channel 20A for attaching the drawer front latching mechanism 10A to the drawer (not shown) is mounted to an edge 22A of a support plate back plate portion 18A that is generally adjacent an extremity defining a face portion 24A and an inwardly extending lip 26A. The face portion 24A includes a lengthwise channel 30A along a middle portion and an arcuate pivot groove 32A along a top inside surface of the face portion 24A.

An elongated handle 36A has a beaded top edge (not shown) sized to fit within the pivot groove 32A of the support member 16A. The pivotal handle 36A also includes a generally L-shaped grip 38A extending from a bottom end 40A of the handle 36A outwardly from the drawer and upward to define an upwardly opening cavity 44A. The grip 38A terminates in a lengthwise bead 42 and forms a hand grip for grasping the handle 36A when opening the drawer.

The handle 36A has notched upper comers sized to accommodate a spring biased latches 46A as described above but in an inverted orientation. As before, the latches 46A extend inwardly through openings 58A in the back plate portion 18A of the support member 16A to a tapered leading end 60A. Each tapered leading end 48A defines a lateral catch surface 62A and an angled top surface 64A extending upwardly from a leading edge 63A to the catch surface 62A.

As in the first described embodiment, the latch mechanism 10A is affixed to the drawer by placing the inverted channel 20A over the top edge of the drawer front with the lip within the drawer. A suitable adhesive or threaded fastener is preferably used to secure the latch mechanism 10A in place near a bottom edge of the support 16A. With the handle 36A released and the drawer, a user can grasp the grip 38A of the handle 36A by laying his or her fingers into the cavity 44A. By pulling outwardly, the handle 36A pivots within the pivot groove 32A in a clockwise direction with respect to the support member 16A about a pivot axis 53A. As the handle 36A is rotated, ledges 56A of the latches 46A are engaged by the handle 36A, which pivots the latches 46A within the pivot groove 32A about the pivot axis 53A toward an open position, as shown in FIG. 7. This action disengages the leading end catch surface 62A of each latch 46A from a corresponding fixed stop portion 66A of the drawer mounting frame suitably located at the sides of the drawer. The drawer can then be opened by continuing to pull outward.

The above description describes preferred embodiments of the present invention. However, the invention may include other aspects not specifically delineated above. For example, the handle may include a pull knob suitably fastened to the support member which may be attached to the drawer front via suitable fasteners or hangers, rather than a lengthwise inverted channel.

Therefore, the above in no way is intended to limit the scope of the invention. Accordingly, in order to apprise the public of the full scope of the present invention, reference must be made to the following claims.

We claim:

1. A latching mechanism for latching closed a movable member of a cabinet, comprising:

a support mounted to the movable member providing a pivotal connection;

pivoting member directly attached to the pivotal connection for pivotal motion with respect to the movable member; and a latch directly attached to the pivotal connection and operated by the pivoting member to pivot between a closed position in which the latch engages the cabinet and an open position in which the latch is free from the cabinet, wherein the latch can pivot independent of the pivoting member.

2. The apparatus of claim 1, wherein the pivoting member is a handle including an elongated grip for grasping.

3. The apparatus of claim 1, further comprising a spring biasing the latch in the closed position.

4. The apparatus of claim 3, wherein the latch has a leading end that includes a catch surface for engagement with a cabinet wall when the latch is in the closed position.

5. The apparatus of claim 4, wherein the catch surface extends from a body of the latch.

6. The apparatus of claim 5, wherein the leading end is tapered to define an angled surface that travels into a latch opening so that the catch surface engages the cabinet wall.

7. The apparatus of claim 2, wherein the movable member is a drawer and the support is attached to a front face of the drawer.

8. The apparatus of claim 7, further comprising a second latch attached at the pivot connection and operated by the handle to pivot between the closed and open positions together with the latch.

9. A latching mechanism for latching closed a movable member of a cabinet, comprising:

a support mounted to the movable member providing a pivotal connection;

a handle attached to the pivotal connection for pivotal motion with respect to the movable member; and a latch attached to the pivotal connection and operated by the handle to pivot between a closed position in which the latch engages the cabinet and an open position in which the latch is free from the cabinet, wherein the latch is pivoted to the open position when the movable member is pulled by the handle away from the cabinet and wherein the latch can engage the cabinet when in the closed position without pivoting the handle;

wherein the movable member is a drawer and the support is attached to a front face of the drawer;

further comprising a second latch attached at the pivot connection and operated by the handle to pivot between the closed and open positions together with the latch;

wherein the support is wider than the drawer front face and the latch and the second latch are positioned at ends of the support extending beyond the front face.

10. The apparatus of claim 9, wherein the support has a downwardly extending lip which engages a top edge of the drawer front face to mount the latch mechanism to the drawer front face.

11. The apparatus of claim 10, wherein the handle extends upwardly in the closed position and when pulled pivots in a counter-clockwise direction with respect to the support.

12. The apparatus of claim 10, wherein the handle extends downwardly in the closed position and when pulled pivots in a clockwise direction with respect to the support.

13. A drawer front latching mechanism, comprising:

an elongated support member of greater length than a drawer front such that an end of the support member extends beyond the drawer front, the support member having a back plate with an opening at the extending end of the support and an integral attachment member for mounting the support member to the drawer front, the support member also having a front extremity defining an arcuate pivot groove;

an elongated handle extending substantially the length of the support member, the handle having a grip for grasping the handle and a beaded pivot edge sized to pivot within the support member pivot groove about a pivot axis, the handle also having an opening at the extending end of the support member; and a first latch having a trailing end disposed at a notch in the handle and a leading end extending through the opening in the support member substantially perpendicular to the drawer front, the leading end having a leading end catch for engaging a portion of a drawer mounting frame corresponding to the extending end of the support member and the trailing end having a beaded pivot edge sized to pivot within the support member pivot groove about the pivot axis, the trailing end also having a trailing end catch sized to engage with the pivot member;

whereby the drawer is unlatched by pivoting the handle about the pivot axis to engage with the trailing end catch so as to disengage the leading end catch from the drawer mounting frame.

14. The apparatus of claim 13, wherein the leading end of the first latch is tapered so as to define an angled surface that travels over the portion of the drawer mounting frame as the drawer is closed and when the handle is not rotated so that the drawer is latched by the leading end catch engaging with the drawer mounting frame.

15. The apparatus of claim 13, further comprising a spring and wherein the front extremity defines a wall surface, the spring being positioned to contact at one end the wall surface and at the opposite end the trailing end of the first latch so as to bias the leading end catch in engagement with the drawer mounting frame when the drawer is shut and the handle is released.

16. The apparatus of claim 15, further comprising a second latch at a second notch in the handle and a second opening in the support member back plate and wherein the support member extends past the drawer front at both ends such that the drawer front is between the first and second latches when the apparatus is attached to the drawer front.

17. The apparatus of claim 16, wherein the second latch has a leading end and a trailing end wherein the leading end has a leading end catch for engaging with a second portion of the drawer mounting frame corresponding to the second opening in the support member back plate and the trailing end has a beaded pivot edge sized to pivot within the support member pivot groove about the pivot axis, the trailing end also having a trailing end catch sized to engage with the handle, whereby the drawer is unlatched by rotating the handle about the pivot axis to engage with the trailing end catches of the first and second latches so as to disengage the leading end catch of the first and second latches from the drawer mounting frame.

18. The apparatus of claim 17, further comprising a second spring positioned adjacent to the trailing end of the second latch for biasing the second latch leading end catch in engagement with the drawer mounting frame.

19. The apparatus of claim 18, further comprising end caps for covering the ends of the support member so as to retain the first and second latches within the support member.

20. The apparatus of claim 13, wherein the attachment member is an inverted channel proximate a rear surface proximate the top edge of the support member back plate extending substantially the length of the support member and sized to receive a top edge of the drawer front.

21. The apparatus of claim 1, wherein the latch is disengaged from the cabinet and the movable member is moved with respect to the cabinet by pulling the pivoting member away from the cabinet.

22. The apparatus of claim 1, wherein when the pivoting member is in the closed position the latch can move from an unlatched position in which the latch is disengaged from the cabinet to a latched position in which the latch is engaged with the cabinet without the pivoting member being pivoted.

* * * * *

UNITED STATES PATENT AND TRADEMARK OFFICE

CERTIFICATE OF CORRECTION

PATENT NO. : 6,547,289 B1
DATED : April 15, 2003
INVENTOR(S) : James D. Greenheck et al.

It is certified that error appears in the above-identified patent and that said Letters Patent is hereby corrected as shown below:

Column 3,
Line 1, change “comers” to -- corners --.

Column 4,
Line 19, change “comers” to -- corners --.
Line 59, before “pivoting member” insert -- a --.

Column 6,
Line 28, change “opening” to -- notch --.

Signed and Sealed this

Thirtieth Day of September, 2003

JAMES E. ROGAN
*Director of the United States Patent and Trademark Office*